US009941038B2

(12) United States Patent
Zaizen et al.

(10) Patent No.: US 9,941,038 B2
(45) Date of Patent: Apr. 10, 2018

(54) METHOD FOR PRODUCING SEMI-PROCESSED NON-ORIENTED ELECTRICAL STEEL SHEET HAVING EXCELLENT MAGNETIC PROPERTIES

(71) Applicant: JFE STEEL CORPORATION, Tokyo (JP)

(72) Inventors: Yoshiaki Zaizen, Kurashiki (JP); Yoshihiko Oda, Fukuyama (JP); Hiroaki Toda, Kurashiki (JP); Kazuhiro Hanazawa, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 39 days.

(21) Appl. No.: 14/761,538

(22) PCT Filed: Nov. 21, 2013

(86) PCT No.: PCT/JP2013/081384
§ 371 (c)(1),
(2) Date: Jul. 16, 2015

(87) PCT Pub. No.: WO2014/129034
PCT Pub. Date: Aug. 28, 2014

(65) Prior Publication Data

US 2015/0357101 A1 Dec. 10, 2015

(30) Foreign Application Priority Data

Feb. 21, 2013 (JP) ..... 2013-031607

(51) Int. Cl.
*C22C 38/02* (2006.01)
*H01F 1/147* (2006.01)
(Continued)

(52) U.S. Cl.
CPC ..... *H01F 1/14775* (2013.01); *C21D 6/005* (2013.01); *C21D 6/008* (2013.01);
(Continued)

(58) Field of Classification Search
CPC ..... C21D 6/005; C21D 6/008; C21D 8/12; C21D 8/1222; C21D 8/1233;
(Continued)

(56) References Cited

U.S. PATENT DOCUMENTS 3,935,038 A 1/1976 Shimoyama et al.
3,948,691 A 4/1976 Matsushita et al.
(Continued)

FOREIGN PATENT DOCUMENTS

EP 0866144 A1 9/1998
JP S55-158252 A 12/1980
(Continued)

OTHER PUBLICATIONS

Feb. 4, 2014 International Search Report issued in International Patent Application No. PCT/JP2013/081384.
(Continued)

*Primary Examiner* — Veronica F Faison
(74) *Attorney, Agent, or Firm* — Oliff PLC

(57) ABSTRACT

A steel slab having a chemical composition including C: not more than 0.005 mass %, Si: not more than 4 mass %, Mn: 0.03-2 mass %, P: not more than 0.2 mass %, S: not more than 0.004 mass %, Al: not more than 2 mass %, N: not more than 0.004 mass %, Se: not more than 0.0010 mass % and the balance being Fe and inevitable impurities is subjected to hot rolling, cold rolling and recrystallization annealing up to 740° C. at an average heating rate of not less than 100° C./s to produce a semi-processed non-oriented electrical steel sheet being high in the magnetic flux density and low in the iron loss after stress relief annealing.

4 Claims, 2 Drawing Sheets

(51) Int. Cl.

| | |
|---|---|
| ***C21D 8/12*** | (2006.01) |
| ***C21D 6/00*** | (2006.01) |
| ***C22C 38/04*** | (2006.01) |
| ***C22C 38/06*** | (2006.01) |
| ***C22C 38/00*** | (2006.01) |
| ***H01F 41/02*** | (2006.01) |
| ***C21D 9/46*** | (2006.01) |
| ***C22C 38/60*** | (2006.01) |
| ***H01F 1/16*** | (2006.01) |

(52) U.S. Cl.

CPC ..... *C21D 8/12* (2013.01); *C21D 8/1222* (2013.01); *C21D 8/1233* (2013.01); *C21D 8/1244* (2013.01); *C21D 8/1261* (2013.01); *C21D 8/1272* (2013.01); *C21D 9/46* (2013.01); *C22C 38/00* (2013.01); *C22C 38/001* (2013.01); *C22C 38/004* (2013.01); *C22C 38/02* (2013.01); *C22C 38/04* (2013.01); *C22C 38/06* (2013.01); *C22C 38/60* (2013.01); *H01F 1/16* (2013.01); *H01F 41/02* (2013.01)

(58) Field of Classification Search

CPC .. C21D 8/1244; C21D 8/1261; C21D 8/1272; C21D 9/46; C22C 38/00; C22C 38/001; C22C 38/004; C22C 38/02; C22C 38/04; C22C 38/06

See application file for complete search history.

(56) References Cited

U.S. PATENT DOCUMENTS

| | | | | |
|---|---|---|---|---|
| 4,661,174 | A * | 4/1987 | Miyoshi | C21D 8/1261 148/111 |
| 4,898,627 | A | 2/1990 | Schoen | |
| 5,955,201 | A | 9/1999 | Loudermilk et al. | |
| 6,139,650 | A | 10/2000 | Oda et al. | |
| 7,011,139 | B2 | 3/2006 | Schoen et al. | |
| 2007/0062611 | A1 * | 3/2007 | Murakami | C21D 8/1244 148/111 |
| 2013/0146187 | A1 | 6/2013 | Zaizen et al. | |
| 2013/0263981 | A1 * | 10/2013 | Zaizen | C21D 8/1255 148/645 |
| 2015/0059929 | A1 * | 3/2015 | Zaizen | C21D 8/12 148/111 |
| 2015/0357101 | A1 | 12/2015 | Zaizen et al. | |
| 2016/0273064 | A1 * | 9/2016 | Kataoka | C21D 8/12 |

FOREIGN PATENT DOCUMENTS

| | | | |
|---|---|---|---|
| JP | S64-004455 | A | 6/1987 |
| JP | S62-180014 | A | 8/1987 |
| JP | H02-11728 | A | 1/1990 |
| JP | H03-126845 | A | 5/1991 |
| JP | H03-223424 | A | 10/1991 |
| JP | H05-214444 | A | 8/1993 |
| JP | H06-43614 | B2 | 6/1994 |
| JP | H06-051889 | | 7/1994 |
| JP | H06-228644 | A | 8/1994 |
| JP | H06-228645 | A | 8/1994 |
| JP | H11-71650 | A | 3/1999 |
| JP | 2001-158949 | A | 6/2001 |
| JP | 2001-316729 | A | 11/2001 |
| JP | 2001-323344 | A | 11/2001 |
| JP | 2004-332042 | A | 11/2004 |
| JP | 2005-200755 | A | 7/2005 |
| JP | 2005-206887 | A | 8/2005 |
| JP | 2007-046104 | A | 2/2007 |
| JP | 2007-217744 | A | 8/2007 |
| JP | 2008-127600 | A | 6/2008 |
| JP | 2008-150697 | A | 7/2008 |
| JP | 2008-231504 | A | 10/2008 |
| JP | 2012-046806 | A | 3/2012 |
| JP | 2012-149337 | A | 8/2012 |
| JP | H05-005126 | B2 | 8/2012 |
| JP | 2013-010982 | A | 1/2013 |
| RU | 2398894 | C1 | 9/2010 |
| WO | 2012/029621 | A1 | 3/2012 |
| WO | 2013/137092 | A1 | 9/2013 |

OTHER PUBLICATIONS

Nov. 18, 2016 Office Action issued in Russian Patent Application No. 2015139800.
Jan. 12, 2017 Office Action issued in U.S. Appl. No. 14/385,397.
Dec. 30, 2015 Office Action issued in Taiwanese Patent Application No. 102148447.
Jan. 13, 2016 Office Action issued in Japanese Patent Application No. 2015-501273.
Mar. 10, 2016 Office Action issued in Chinese Patent Application No. 201380071240.4.
Dec. 4, 2014 Office Action issued in U.S. Appl. No. 13/992,011.
May 21, 2015 Office Action issued in U.S. Appl. No. 13/992,011.
Sep. 1, 2015 Office Action issued in U.S. Appl. No. 13/992,011.
Nov. 4, 2015 Office Action issued in U.S. Appl. No. 13/992,011.
May 13, 2016 Office Action issued in U.S. Appl. No. 13/992,011.
Aug. 25, 2016 Office Action issued in U.S. Appl. No. 13/992,011.
May 9, 2016 Search Report issued in European Patent Application No. 13875382.7.
Apr. 25, 2016 Office Action issued in Korean Patent Application No. 2015-7018407.
Jian Wang et al. "Rapid Heating Effects on Grain-Size, Texture and Magnetic Properties of 3% Si Non-Oriented Electrical Steel". Bulletin of Materials Science, Springer, India, New Delhi, vol. 34, No. 7, Jun. 17, 2012, pp. 1477-1482.
Brissonneau, Pierre. "Non-Oriented Electrical Sheets". Journal of Magentism and Magnetic Materials, vol. 41, Jan. 1, 1984, pp. 38-46.
Petrovic, Darja Steiner. "Non-Oriented Electrical Steel Sheets" Materials and Technology, vol. 44, No. 6, Jan. 1, 2010, pp. 317-325.
Walter Meichsner et al. "Secondary Steelmaking to Ensure Stringent Quality Demands in Strand Cast Steels". Thyssen Technische Berichte, vol. 22, No. 1, Jan. 1, 1990, pp. 13-34.
D. Steiner Petrovic et al. "A Hraes Study of the Morphology of Non-Metallic Inclusions in Non-Oriented Electrical Steel Containing Cu and Se". Vacuum, vol. 71, No. 1-2, May 1, 2003, pp. 33-40.
Jul. 12, 2017 Office Action issued in U.S. Appl. No. 14/385,397.
Aug. 15, 2017 Office Action issued in Chinese Patent Application No. 201380071240.4.
Oct. 7, 2015 Office Action issued in Japanese Patent Application No. 2015-501273.
Dec. 21, 2017 Office Action issued in Chinese Patent Application No. 201380071240.4.
Jan. 5, 2018 Office Action issued in European Patent Application No. 13875382.7.

* cited by examiner

METHOD FOR PRODUCING SEMI-PROCESSED NON-ORIENTED ELECTRICAL STEEL SHEET HAVING EXCELLENT MAGNETIC PROPERTIES

TECHNICAL FIELD

This invention relates to a method for producing a semi-processed non-oriented electrical steel sheet, and more particularly to a method for producing a semi-processed non-oriented electrical steel sheet having excellent magnetic properties.

RELATED ART

In the recent global trend for energy-saving, electric instruments are strongly desired to have a higher efficiency. Since the non-oriented electrical steel sheets are widely used as a core material for the electric instruments, in order to make the efficiency of the electric instrument higher, it is necessary that the non-oriented electrical sheet is high in the magnetic flux density and low in the iron loss. In response to such a need on the non-oriented electric steel sheet, it is mainly attempted to decrease the iron loss by adding an element for increasing a specific resistance such as Si, Al or the like or by decreasing a sheet thickness, and it is attempted to increase the magnetic flux density by coarsening a crystal grain size before the cold rolling or by properly adjusting a rolling reduction in the cold rolling.

As to the non-oriented electrical steel sheet, there are full-processed materials used without annealing after punching out into a given core form and semi-processed materials used by subjecting to stress-relief annealing after the punching to improve magnetic properties. In the latter semi-processed materials, there is a merit that the crystal grains before the punching are made small for improving the punching property and then the crystal grains are coarsened by stress relief annealing, whereby the good iron loss property can be obtained. However, {111} grains are developed with the growth of the crystal grains, so that there is a problem of decreasing the magnetic flux density.

As to this problem, for example, Patent Document 1 discloses that the semi-processed material having excellent magnetic properties after the stress relief annealing is obtained by including Mn of 0.75-1.5 mass % and existing a greater amount of C as compared to Mn and performing an annealing after the cold rolling in the coexistence of Mn and C to render C content into not more than 0.005%.

PRIOR ART DOCUMENTS

Patent Documents

Patent Document 1: JP-B-H06-043614

SUMMARY OF THE INVENTION

Task to be Solved by the Invention

However, the method of Patent Document 1 has a problem that it is necessary to perform decarburization annealing before the formation of a final product sheet owing to the addition of C and hence the production cost becomes increased.

The invention is made in view of the above problems inherent to the conventional art and an object thereof is to provide a semi-processed non-oriented electrical steel sheet having a high magnetic flux density and a low iron loss after stress relief annealing cheaply.

Solution for Task

The inventors have made various studies for solving the above task. As a result, it has been found that non-oriented electrical steel sheets being considerably excellent in the magnetic flux density and iron loss property after the stress relief annealing are obtained by decreasing Se included as an impurity as far as possible and performing rapid heating at a heating rate in recrystallization annealing after cold rolling higher than the conventional one, and the invention has been accomplished.

That is, the invention is a method for producing a semi-processed non-oriented electrical steel sheet by subjecting a steel slab having a chemical composition comprising C: not more than 0.005 mass %, Si: not more than 4 mass %, Mn: 0.03-2 mass %, P: not more than 0.2 mass %, S: not more than 0.004 mass %, Al: not more than 2 mass %, N: not more than 0.004 mass %, Se: not more than 0.0010 mass % and the balance being Fe and inevitable impurities to hot rolling, cold rolling and recrystallization annealing, characterized in that the recrystallization annealing is performed by heating up to 740° C. at an average heating rate of not less than 100° C./s.

The steel slab used in the invention contains 0.003-0.5 mass % of one or two of Sn and Sb in addition to the above chemical composition.

Also, the steel slab used in the invention contains 0.0010-0.005 mass % of Ca in addition to the above chemical composition.

Effect of the Invention

According to the invention, it is possible to cheaply provide a non-oriented electrical steel sheet having excellent magnetic properties, which contributes to make higher an efficiency of an electrical instrument such as rotating machine, small-size transformer or the like without adding a special element.

EMBODIMENTS FOR CARRYING OUT THE INVENTION

At first, experiments building a momentum on the development of the invention will be described below.

In order to investigate an influence of a heating rate in recrystallization annealing upon magnetic properties after stress relief annealing, a steel slab containing C: 0.0025 mass %, Si: 2.0 mass %, Mn: 0.10 mass %, P: 0.01 mass %, Al: 0.001 mass %, N: 0.0019 mass %, S: 0.0020 mass % and Se: 0.0002 mass % is reheated at 1100° C. for 30 minutes, hot rolled to obtain a hot rolled sheet of 2.0 mm in thickness, which is subjected to a hot band annealing at 980° C. for 30 seconds and a first cold rolling to obtain a cold rolled sheet of 0.35 mm in thickness. Thereafter, the sheet is heated in a direct electrical heating furnace by variously changing an average heating rate up to 740° C. within a range of 30-300° C./s, held at 740° C. for 10 seconds and cooled to obtain a cold rolled and annealed sheet.

Figure 1:
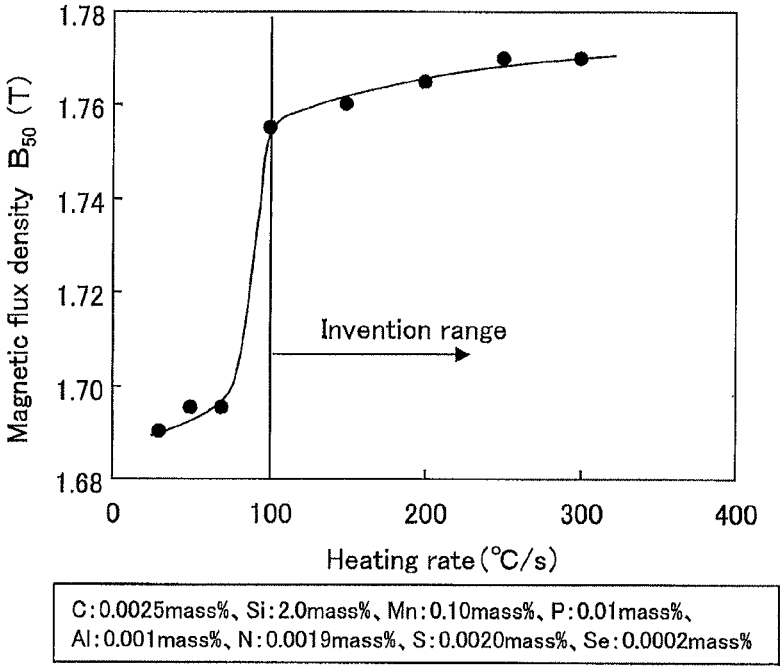
FIG. 1 is a graph showing an influence of a heating rate in recrystallization annealing upon a magnetic flux density after stress relief annealing.
Figure 2:
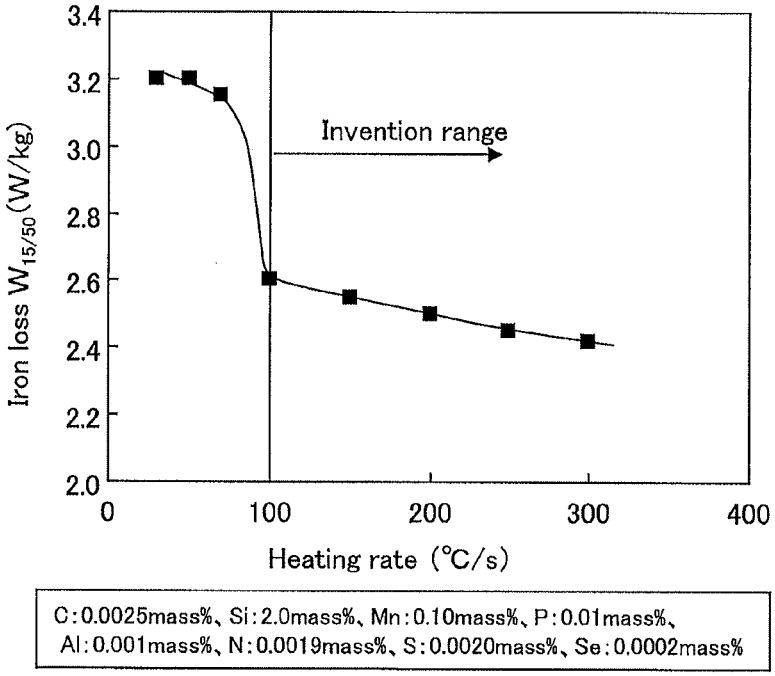
FIG. 2 is a graph showing an influence of a heating rate in recrystallization annealing upon an iron loss after stress relief annealing.

From the thus cold rolled and annealed sheet are cut out a L-direction specimen with L: 180 mm x C: 30 mm and a C-direction specimen with L: 30 mm×C: 180 mm, which are subjected to stress relief annealing at 750° C. for 2 hours and then magnetic properties thereof (magnetic flux density $B_{50}$, iron loss $W_{15/50}$) are measured by Epstein method to obtain results shown in FIGS. 1 and 2.

As seen from these figures, the magnetic properties can be significantly improved by setting the average heating rate in the recrystallization annealing to not less than 100° C./s. This is considered due to the fact that recrystallization of {111} grains is suppressed by increasing the heating rate in the recrystallization annealing to promote recrystallization of {110} grains or {100} grains and hence {111} grains are encroached with {110} grains or {100} grains during the stress relief annealing to preferentially perform the grain growth to thereby improve the magnetic properties.

Based on the above knowledge, non-oriented electrical steel sheets are produced by tapping several charges of steel having a chemical composition similar to that of the steel used in the above experiment from which are cut out Epstein specimens in the same manner as mentioned above. As the magnetic properties are measured after the stress relief annealing, a large deviation is observed. When a specimen having good properties is compared with a specimen having bad properties for investigating this cause, it is clear in the specimen having bad magnetic properties that a great number of MnSe are precipitated in grain boundaries and also the grain size after the stress relief annealing becomes small.

In order to investigate an influence of Se content upon the grain growth in the stress relief annealing, a steel containing C: 0.0021 mass %, Si: 1.8 mass %, Mn: 0.50 mass %, P: 0.03 mass %, S: 0.0019 mass %, Al: 0.3 mass % and 0.0025 mass % as a basic ingredient and added with Se varied within an range of Tr.-0.0050 mass % is melted in a laboratory to form a steel ingot, which is hot rolled to form a hot rolled sheet of 2.0 mm in thickness. Thereafter, the sheet is cold rolled to a sheet thickness of 0.35 mm, heated to 740° C. in a direct electrical heating furnace at an average heating rate of 200° C./s, heated from 740° C. to 800° C. at 30° C./s, held at this temperature for 10 seconds and cooled to obtain a cold rolled and annealed sheet.

Figure 3:
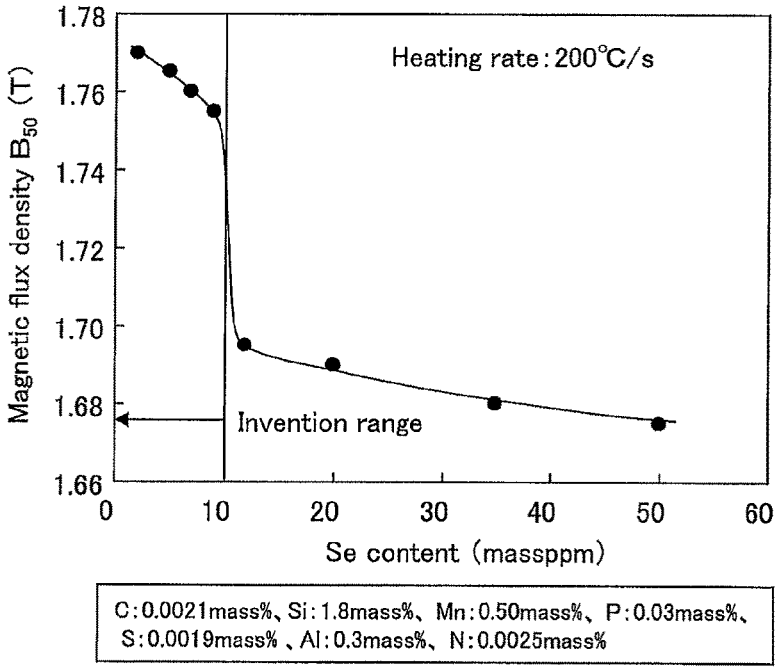
FIG. 3 is a graph showing an influence of Se content upon a magnetic flux density after stress relief annealing.
Figure 4:
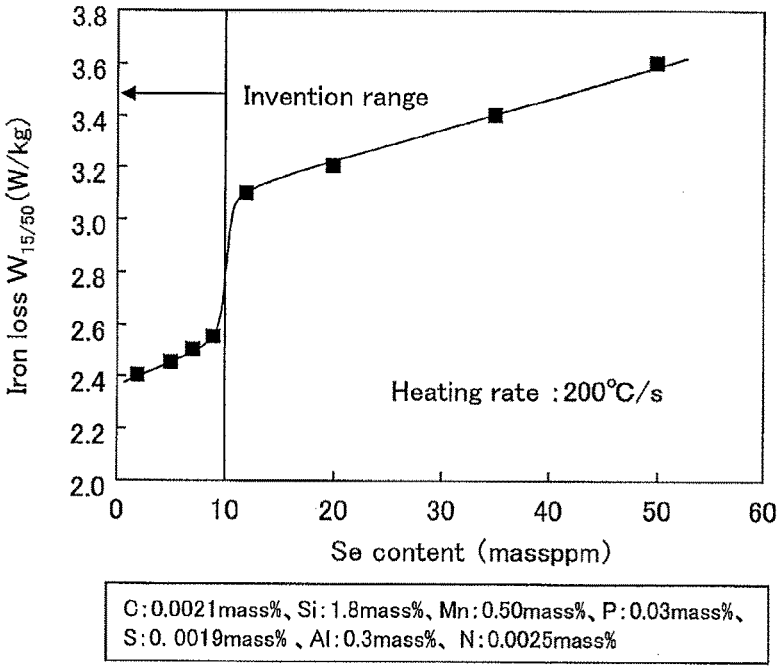
FIG. 4 is a graph showing an influence of Se content upon an iron loss after stress relief annealing.

From the thus cold rolled and annealed sheet are cut out a L-direction specimen with L: 180 mm×C: 30 mm and a C-direction specimen with L: 30 mm×C: 180 mm, which are subjected to stress relief annealing at 750° C. for 2 hours and then magnetic properties thereof (magnetic flux density $B_{50}$, iron loss $W_{15/50}$) are measured by Epstein method to obtain results shown in FIGS. 3 and 4.

As seen from these figures, the magnetic properties are improved by decreasing Se content to not more than 0.0010 mass %. In other words, when Se is added in an amount exceeding 0.0010 mass %, MnSe is precipitated in the grain boundaries to obstruct the grain growth in the stress relief annealing and deteriorate the magnetic properties. The invention is made based on the above new knowledge.

The chemical composition of the non-oriented electrical steel sheet (product sheet) according to the invention will be described below.

C: Not More Than 0.005 Mass %

When C is included in a product steel sheet at an amount exceeding 0.005 mass %, magnetic aging is caused to deteriorate the iron loss property, so that an upper limit is 0.005 mass %. Preferably, the content is not more than 0.003 mass %.

Si: Not More Than 4 Mass %

Si is an element effective for increasing a specific resistance of steel and reducing an iron loss and is preferable to be added in an amount of not less than 1 mass % for obtaining such an effect. On the other hand, when it is added in an amount exceeding 4 mass %, the magnetic flux density is lowered or it is difficult to produce the sheet by rolling, so that the upper limit is 4 mass %. It is preferably within a range of 1-4 mass %, more preferably within a range of 1.5-3 mass %.

Mn: 0.03-2 Mass %

Mn is an element effective for improving hot workability. When the content is less than 0.03 mass %, satisfactory effect is not obtained, while when it exceeds 2 mass %, the increase of raw material cost is caused, so that it is a range of 0.03-2 mass %. The content is preferably within a range of 0.05-2 mass %, more preferably within a range of 0.1-1.6 mass %.

P: Not More Than 0.2 Mass %

P is an element effective for increasing a specific resistance of steel and reducing an iron loss. When it is added in an amount exceeding 0.2 mass %, steel is hardened to deteriorate the rolling property, so that the upper limit is 0.2 mass %. Preferably, it is a range of 0.01-0.1 mass %.

S: Not More Than 0.004 Mass %

S is an element inevitably incorporated as an impurity. When it is contained in an amount exceeding 0.004 mass %, sulfide-based precipitates are formed to obstruct grain growth during stress relief annealing and deteriorate the magnetic properties. In the invention, the upper limit is 0.004 mass %. Preferably, it is not more than 0.003 mass %.

Al: Not More Than 2 Mass %

Al is an element effective for increasing a specific resistance of steel and reducing an iron loss like Si. When it is added in an amount exceeding 2 mass %, it is difficult to produce the sheet by rolling, so that the upper limit is 2 mass %. The lower limit is not particularly restricted, but may be 0 mass %. It is preferably within a range of 0.001-2 mass %, more preferably within a range of 0.1-1 mass %.

N: Not More Than 0.004 Mass %

N is an element inevitably incorporated as an impurity. When it is contained in an amount exceeding 0.004 mass %, nitride-based precipitates are formed to obstruct grain growth during stress relief annealing and deteriorate the magnetic properties. In the invention, the upper limit is 0.004 mass %. Preferably, it is not more than 0.003 mass %.

Se: Not More Than 0.0010 Mass %

Se is a harmful element deteriorating the magnetic properties after the stress relief annealing as seen from the aforementioned experimental results. In the invention, therefore, Se is restricted to not more than 0.0010 mass %. Preferably, it is not more than 0.0005 mass %.

The non-oriented electrical steel sheet according to the invention may properly contain the following ingredients in addition to the above essential ingredients.

Sn, Sb: 0.003-0.5 Mass % Each

Sn and Sb are elements having function effects that the texture is improved to increase the magnetic flux density and also the oxidation or nitriding of surface layer in the steel sheet and the formation of fine particles in the surface layer associated therewith are suppressed to prevent the deterioration of the magnetic properties. In order to obtain such an effect, one or two of Sn and Sb are preferable to be added in an amount of not less than 0.003 mass % each. While when they are added in an amount exceeding 0.5 mass % each, the growth of crystal grains is inversely obstructed to bring about the deterioration of the magnetic properties. Therefore, each of Sn and Sb is preferable to be added in an amount of 0.003-0.5 mass %.

Ca: 0.0010-0.005 Mass %

Ca is composited with Se compound to form coarse precipitates, so that it has an effect of promoting the grain growth during stress relief annealing to improve the magnetic properties. In order to develop such an effect, it is preferable to be added in an amount of not less than 0.0010 mass %. On the other hand, when it is added in an amount exceeding 0.005 mass %, an amount of CaS precipitated becomes larger and the iron loss is rather increased, so that the upper limit is preferable to be 0.005 mass %.

Moreover, the remainder other than the above ingredients in the non-oriented electrical steel sheet according to the invention is Fe and inevitable impurities. However, the other elements may not be refused as long as they are included within a range damaging no function effect of the invention.

Next, the method for producing a semi-processed non-oriented electrical steel sheet according to the invention will be described below.

In the production method of the non-oriented electrical steel sheet according to the invention, a steel having the above chemical composition adapted to the invention is first melted by a usual refining process using a converter, am electric furnace, a vacuum degassing device or the like and shaped into a steel slab by a continuous casting method or an ingot making-blooming method.

Then, the steel slab is hot rolled by a usual method to form a hot rolled sheet and subjected to a hot band annealing as required. The hot band annealing is not an essential step in the invention, but is effective for improving the magnetic properties, so that it is preferable to be adopted properly. In case of the hot band annealing, an annealing temperature is preferable to be a range of 750-1050° C. When the annealing temperature is lower than 750° C., a non-recrystallized texture remains and hence there is a fear that the effect by the hot band annealing is not obtained, while when it exceeds 1050° C., a great burden is applied to the annealing equipment. It is more preferably within a range of 800-1000° C.

The steel sheet after the hot rolling or after the hot band annealing followed to the hot rolling is pickled and thereafter subjected to a single cold rolling or two or more cold rollings sandwiching an intermediate annealing therebetween to obtain a cold rolled sheet having a final sheet thickness. In this case, the rolling conditions such as rolling reduction and the like may be same as in the usual production conditions of the non-oriented electrical steel sheet.

Then, the steel sheet after the cold rolling is subjected to a recrystallization annealing. The recrystallization annealing is a most important step in the invention. As a heating condition thereof, rapid heating is necessary to be performed up to a recrystallization temperature zone, concretely the rapid heating is necessary to be performed in a zone of room temperature to 740° C. at an average heating rate of not less than 100° C./s. Moreover, an end-point temperature of the rapid heating is 740° C. being a temperature of completing at least recrystallization, but may be a temperature exceeding 740° C. However, as the end-point temperature becomes higher, an equipment cost or power cost required for the heating is increased, which is not favorable in the cheap production of the sheet. The method of performing the rapid heating at a rate of not less than 100° C./s is not particularly limited, but a method such as an electric heating method, an induction heating method or the like can be used preferably.

Thereafter, the steel sheet recrystallized by the rapid heating is properly subjected to a soaking annealing and cooled to obtain a product sheet. Moreover, the soaking temperature, heating rate from the recrystallization temperature to the soaking temperature and soaking time are not particularly limited, but are sufficient to be same as in the conditions used in the production of the usual non-oriented electrical steel sheet. For example, it is preferable that the heating rate from 740° C. to the soaking temperature is 1-50° C./s, and the soaking temperature is 740-950° C. and the soaking time is 5-60 seconds. More preferably, the soaking temperature is a range of 740-900° C. Also, cooling condition after the soaking annealing is not particularly limited.

EXAMPLES

A steel having a chemical composition shown in Table 1 is melted and shaped into a steel slab. The steel slab is reheated at 1080° C. for 30 minutes and hot rolled to obtain a hot rolled sheet of 2.0 mm in thickness, which is subjected to a hot band annealing under various conditions shown in Table 1 and cold rolled at once to obtain a cold rolled sheet having a sheet thickness shown in Table 1. Thereafter, the cold rolled sheet is rapidly heated in a direct electric heating furnace up to an end-point temperature of the rapid heating under conditions shown in Table 1, heated to a soaking temperature at 20° C./s, held for 10 seconds and cooled to obtain a cold rolled and annealed sheet (non-oriented electrical steel sheet).

From the thus cold rolled and annealed sheet are cut out a L-direction sample with L: 180 mm×C: 30 mm and a C-direction sample with C: 180 mm×L: 30 mm, which are subjected to a stress relief annealing at 750° C. for 2 hours to measure magnetic properties (magnetic flux density $B_{50}$, iron loss $W_{15/50}$) by Epstein method.

TABLE 1

| | Chemical composition (mass %) | | | | | | | | | | | Sheet thickness | Recrystallization annealing | | | Magnetic properties | | |
|---|---|---|---|---|---|---|---|---|---|---|---|---|---|---|---|---|---|---|
| | | | | | | | | | | | | | Heating rate | End-point temperature of rapid heating | Soaking temperature | Magnetic flux density $B_{50}$ | Iron loss $W_{15/50}$ | |
| No | C | Si | Mn | P | S | Al | N | Se | Sn | Sb | Ca | (mm) | (° C./s) | (° C.) | (° C.) | (T) | (W/kg) | Remarks |
| 1 | 0.0025 | 2.50 | 0.50 | 0.02 | 0.0018 | 0.001 | 0.0023 | 0.0002 | tr. | tr. | tr. | 0.35 | 300 | 740 | 800 | 1.760 | 2.20 | Invention Example |
| 2 | 0.0025 | 3.00 | 0.50 | 0.01 | 0.0015 | 0.001 | 0.0021 | 0.0002 | tr. | tr. | tr. | 0.35 | 250 | 740 | 820 | 1.750 | 2.10 | Invention Example |
| 3 | 0.0025 | 2.00 | 0.50 | 0.01 | 0.0016 | 0.001 | 0.0025 | 0.0003 | tr. | tr. | tr. | 0.35 | 30 | 740 | 800 | 1.690 | 3.20 | Comparative Example |
| 4 | 0.0025 | 2.00 | 0.50 | 0.01 | 0.0016 | 0.001 | 0.0025 | 0.0003 | tr. | tr. | tr. | 0.35 | 80 | 740 | 800 | 1.695 | 3.15 | Comparative Example |
| 5 | 0.0025 | 3.00 | 0.50 | 0.25 | 0.0015 | 0.001 | 0.0021 | 0.0002 | tr. | tr. | tr. | * | — | — | — | — | — | Comparative Example |
| 6 | 0.0025 | 0.80 | 0.30 | 0.05 | 0.0021 | 0.300 | 0.0025 | 0.0003 | tr. | tr. | tr. | 0.35 | 200 | 750 | 850 | 1.780 | 2.50 | Invention Example |
| 7 | 0.0035 | 1.00 | 0.06 | 0.05 | 0.0022 | 0.800 | 0.0028 | 0.0002 | tr. | tr. | tr. | 0.35 | 150 | 760 | 830 | 1.760 | 2.45 | Invention Example |
| 8 | 0.0035 | 2.00 | 0.10 | 0.01 | 0.0025 | 0.500 | 0.0022 | 0.0002 | tr. | tr. | tr. | 0.35 | 130 | 770 | 780 | 1.755 | 2.40 | Invention Example |
| 9 | 0.0030 | 3.70 | 0.06 | 0.01 | 0.0025 | 0.002 | 0.0021 | 0.0002 | tr. | tr. | tr. | 0.35 | 300 | 740 | 800 | 1.750 | 2.00 | Invention Example |
| 10 | 0.0030 | 4.50 | 0.15 | 0.08 | 0.0017 | 0.001 | 0.0023 | 0.0002 | tr. | tr. | tr. | * | — | — | — | — | — | Comparative Example |
| 11 | 0.0030 | 1.50 | 0.60 | 0.05 | 0.0015 | 0.500 | 0.0021 | 0.0003 | tr. | tr. | tr. | 0.35 | 250 | 740 | 850 | 1.760 | 2.55 | Invention Example |
| 12 | 0.0025 | 1.00 | 0.10 | 0.01 | 0.0028 | 1.00 | 0.0033 | 0.0002 | tr. | tr. | tr. | 0.35 | 200 | 740 | 880 | 1.755 | 2.52 | Invention Example |
| 13 | 0.0035 | 1.00 | 0.20 | 0.01 | 0.0022 | 1.50 | 0.0016 | 0.0002 | tr. | tr. | tr. | 0.35 | 300 | 740 | 800 | 1.755 | 2.50 | Invention Example |
| 14 | 0.0025 | 3.00 | 0.50 | 0.01 | 0.0021 | 2.50 | 0.0019 | 0.0002 | tr. | tr. | tr. | * | — | — | — | — | — | Comparative Example |
| 15 | 0.0035 | 2.00 | 1.00 | 0.01 | 0.0030 | 0.001 | 0.0026 | 0.0003 | tr. | tr. | tr. | 0.35 | 200 | 740 | 770 | 1.760 | 2.52 | Invention Example |
| 16 | 0.0040 | 0.50 | 1.50 | 0.01 | 0.0015 | 0.001 | 0.0021 | 0.0002 | tr. | tr. | tr. | 0.35 | 250 | 740 | 740 | 1.760 | 2.50 | Invention Example |
| 17 | 0.0025 | 2.50 | 4.00 | 0.10 | 0.0021 | 0.001 | 0.0019 | 0.0002 | tr. | tr. | tr. | * | — | — | — | — | — | Comparative Example |
| 18 | 0.0030 | 2.00 | 0.15 | 0.01 | 0.0060 | 0.002 | 0.0015 | 0.0002 | tr. | tr. | tr. | 0.35 | 250 | 740 | 800 | 1.680 | 3.20 | Comparative Example |
| 19 | 0.0025 | 2.00 | 0.15 | 0.01 | 0.0019 | 0.002 | 0.0080 | 0.0002 | tr. | tr. | tr. | 0.35 | 300 | 740 | 810 | 1.670 | 3.25 | Comparative Example |
| 20 | 0.0025 | 3.00 | 0.50 | 0.01 | 0.0015 | 0.001 | 0.0021 | 0.0002 | 0.80 | tr. | tr. | 0.35 | 250 | 750 | 800 | 1.690 | 2.95 | Comparative Example |
| 21 | 0.0025 | 3.00 | 0.50 | 0.01 | 0.0015 | 0.002 | 0.0021 | 0.0002 | tr. | 0.70 | tr. | 0.35 | 250 | 740 | 840 | 1.680 | 3.00 | Comparative Example |
| 22 | 0.0025 | 2.00 | 0.50 | 0.02 | 0.0018 | 0.001 | 0.0023 | 0.0005 | tr. | tr. | tr. | 0.35 | 300 | 740 | 740 | 1.750 | 2.45 | Invention Example |
| 23 | 0.0025 | 2.00 | 0.50 | 0.02 | 0.0018 | 0.001 | 0.0023 | 0.0007 | tr. | tr. | tr. | 0.35 | 300 | 740 | 740 | 1.750 | 2.50 | Invention Example |
| 24 | 0.0025 | 2.00 | 0.50 | 0.02 | 0.0018 | 0.001 | 0.0023 | 0.0015 | tr. | tr. | tr. | 0.35 | 300 | 740 | 740 | 1.690 | 3.05 | Comparative Example |
| 25 | 0.0025 | 2.80 | 0.50 | 0.01 | 0.0022 | 0.003 | 0.0021 | 0.0002 | 0.005 | tr. | tr. | 0.35 | 300 | 740 | 800 | 1.760 | 2.20 | Invention Example |
| 26 | 0.0025 | 2.80 | 0.50 | 0.01 | 0.0022 | 0.003 | 0.0021 | 0.0002 | 0.040 | tr. | tr. | 0.35 | 250 | 740 | 800 | 1.765 | 2.15 | Invention Example |
| 27 | 0.0025 | 2.80 | 0.50 | 0.01 | 0.0022 | 0.003 | 0.0021 | 0.0002 | 0.100 | tr. | tr. | 0.35 | 250 | 740 | 820 | 1.768 | 2.15 | Invention Example |
| 28 | 0.0025 | 2.80 | 0.50 | 0.01 | 0.0022 | 0.003 | 0.0021 | 0.0002 | 0.400 | tr. | tr. | 0.35 | 250 | 740 | 790 | 1.765 | 2.18 | Invention Example |

TABLE 1-continued

| | Chemical composition (mass %) | | | | | | | | | | | Sheet thickness | Recrystallization annealing | | | Magnetic properties | | |
|---|---|---|---|---|---|---|---|---|---|---|---|---|---|---|---|---|---|---|
| | | | | | | | | | | | | | Heating rate | End-point temperature of rapid heating | Soaking temperature | Magnetic flux density $B_{50}$ | Iron loss $W_{15/50}$ | |
| No | C | Si | Mn | P | S | Al | N | Se | Sn | Sb | Ca | (mm) | (° C./s) | (° C.) | (° C.) | (T) | (W/kg) | Remarks |
| 29 | 0.0025 | 2.50 | 0.50 | 0.01 | 0.0027 | 0.004 | 0.0026 | 0.0003 | tr. | 0.005 | tr. | 0.35 | 300 | 740 | 830 | 1.765 | 2.30 | Invention Example |
| 30 | 0.0025 | 2.50 | 0.50 | 0.01 | 0.0027 | 0.004 | 0.0026 | 0.0003 | tr. | 0.040 | tr. | 0.35 | 300 | 740 | 860 | 1.770 | 2.25 | Invention Example |
| 31 | 0.0025 | 2.50 | 0.50 | 0.01 | 0.0027 | 0.004 | 0.0026 | 0.0003 | tr. | 0.100 | tr. | 0.35 | 300 | 740 | 800 | 1.770 | 2.22 | Invention Example |
| 32 | 0.0025 | 2.50 | 0.50 | 0.01 | 0.0027 | 0.004 | 0.0026 | 0.0003 | tr. | 0.400 | tr. | 0.35 | 300 | 740 | 740 | 1.770 | 2.20 | Invention Example |
| 33 | 0.0025 | 3.00 | 0.05 | 0.01 | 0.0020 | 0.001 | 0.0025 | 0.0002 | 0.040 | 0.040 | tr. | 0.35 | 300 | 740 | 760 | 1.770 | 2.05 | Invention Example |
| 34 | 0.0025 | 3.00 | 0.05 | 0.01 | 0.0020 | 0.001 | 0.0025 | 0.0002 | 0.040 | 0.040 | 0.0015 | 0.35 | 300 | 740 | 800 | 1.778 | 2.00 | Invention Example |
| 35 | 0.0025 | 3.00 | 0.05 | 0.01 | 0.0025 | 0.001 | 0.0025 | 0.0002 | 0.040 | 0.040 | 0.0029 | 0.35 | 300 | 740 | 800 | 1.775 | 2.01 | Invention Example |
| 36 | 0.0025 | 3.00 | 0.05 | 0.01 | 0.0035 | 0.001 | 0.0025 | 0.0002 | 0.040 | 0.040 | 0.0040 | 0.35 | 300 | 740 | 800 | 1.772 | 2.03 | Invention Example |
| 37 | 0.0025 | 3.00 | 0.05 | 0.01 | 0.0021 | 0.001 | 0.0025 | 0.0002 | 0.040 | 0.040 | 0.0100 | 0.35 | 300 | 740 | 800 | 1.695 | 3.00 | Comparative Example |
| 38 | 0.0025 | 2.20 | 0.50 | 0.01 | 0.0024 | 0.002 | 0.0021 | 0.0002 | tr. | tr. | tr. | 0.30 | 250 | 740 | 810 | 1.760 | 2.10 | Invention Example |
| 39 | 0.0025 | 2.20 | 0.50 | 0.01 | 0.0025 | 0.003 | 0.0022 | 0.0002 | tr. | tr. | tr. | 0.25 | 300 | 740 | 790 | 1.750 | 1.95 | Invention Example |
| 40 | 0.0025 | 2.20 | 0.50 | 0.01 | 0.0025 | 0.003 | 0.0022 | 0.0002 | tr. | tr. | tr. | 0.20 | 300 | 740 | 790 | 1.750 | 1.85 | Invention Example |
| 41 | 0.0032 | 1.50 | 0.10 | 0.10 | 0.0019 | 0.001 | 0.0021 | 0.0002 | tr. | tr. | tr. | 0.30 | 300 | 740 | 800 | 1.780 | 2.50 | Invention Example |

Note:
Symbol * shows that the production is impossible because breakage is caused during the cold rolling.

The measured results are shown in Table 1 together with ingredients of steel and recrystallization annealing conditions. As seen from Table 1, all of the non-oriented electrical steel sheets satisfying the chemical composition according to the invention have excellent magnetic properties after the stress relief annealing.

The invention claimed is:

1. A method for producing a semi-processed non-oriented electrical steel sheet by subjecting a steel slab having a chemical composition comprising C: not more than 0.005 mass %, Si: not more than 4 mass %, Mn: 0.03 to 2 mass %, P: not more than 0.2 mass %, S: not more than 0.004 mass %, Al: not more than 2 mass %, N: not more than 0.004 mass %, Se: 0.0002 to 0.0010 mass % and the balance being Fe and inevitable impurities to hot rolling, cold rolling, and recrystallization annealing including soaking annealing, wherein the recrystallization annealing includes heating up to 740° C. at an average heating rate of not less than 100° C./s, and heating during the soaking annealing at a heating rate in a range of 1 to 50° C./s from 740° C. to a soaking temperature in a range of 740° C. to 950° C.

2. The method for producing a semi-processed non-oriented electrical steel sheet according to claim 1, wherein the steel slab contains 0.003 to 0.5 mass % of one or two of Sn and Sb in addition to the above chemical composition.

3. The method for producing a semi-processed non-oriented electrical steel sheet according to claim 1, wherein the steel slab contains 0.0010 to 0.005 mass % of Ca in addition to the above chemical composition.

4. The method for producing a semi-processed non-oriented electrical steel sheet according to claim 2, wherein the steel slab contains 0.0010 to 0.005 mass % of Ca in addition to the above chemical composition.

* * * * *